US005591936A

United States Patent [19]

Willer et al.

[11] Patent Number: 5,591,936

[45] Date of Patent: Jan. 7, 1997

[54] CLEAN SPACE MOTOR/GAS GENERATOR SOLID PROPELLANTS

[75] Inventors: Rodney L. Willer, Newark, Del.; David K. McGrath, Elkton, Md.

[73] Assignee: Thiokol Corporation, Ogden, Utah

[21] Appl. No.: 561,951

[22] Filed: Aug. 2, 1990

[51] Int. Cl.[6] ..... C06B 45/10

[52] U.S. Cl. ..... 149/19.4; 149/19.5

[58] Field of Search ..... 179/19.4

[56] References Cited

U.S. PATENT DOCUMENTS

| | | | |
|---|---|---|---|
| 3,004,840 | 10/1961 | Pruitt et al. | 149/19.4 |
| 3,291,660 | 12/1966 | Oberth et al. | 149/19.4 |
| 3,305,565 | 2/1967 | Mueller . | |
| 3,531,534 | 9/1970 | Adolph . | |
| 3,557,181 | 1/1971 | Lakritz et al. . | |
| 3,756,874 | 9/1973 | Chang et al. | 149/19.4 |
| 3,870,578 | 3/1975 | Nichols | 149/19.4 |
| 4,158,583 | 6/1979 | Frosch | 149/19.4 |
| 4,184,031 | 1/1980 | Graham et al. | 149/19.4 |
| 4,393,199 | 7/1983 | Manser . | |
| 4,483,978 | 11/1984 | Manser | 149/19.4 |
| 4,511,742 | 4/1985 | Yu . | |
| 4,726,919 | 2/1988 | Kristofferson et al. | 149/19.4 |
| 4,799,980 | 1/1989 | Reed | 149/19.4 |
| 4,915,755 | 4/1990 | Kim | 149/19.4 |
| 4,952,254 | 8/1990 | Betts et al. | 149/19.4 |

OTHER PUBLICATIONS

S. D. Morse, Polymerization and Modifications of Low Molecular Weight Polyethers, U. of Dayton Research Inst., Report No. UDR–TR–83–116, 40pp, Oct. 1983.

R. Willer et al., Proceedings of the Jt. Int'l Symp. on Comp. of Plastics and other Mat'ls with Expl., Prop., Pyrotech and Processing of Expl., Prop. and Ingredients, 23–25 Oct. 1989, Virginia Beach, VA, pp. 258–269.

E. Colclough et al., Proceedings of the Jt. Int'l Symp. on Comp. of Plastics and other Mat'ls with Expl., Prop., Pyrotech and Processing of Expl., Prop. and Ingredients, 23–25 Oct. 1989, Virginia Beach, VA, pp. 235–240.

D. Debenham, Proceedings of the Jt. Int'l Symp. on Comp. of Plastics and other Mat'ls with Expl., Prop., Pyrotech and Processing of Expl., Prop. and Ingredients, 23–25 Oct. 1989, Virginia Beach, VA, pp. 119–129.

S. Penczek et al., Lecture at IUPAC 6th Int'l Symp. on Cationic Polymerization & Related Processes, Ghent, Aug. 1983, "Cationic Polymerization and Related Processes", E. J. Goenthals Ed., Academic Press, 1984, pp. 139–154.

K. Brzezinska et al., Makromol. Chem., Rapid Commun., 7, pp. 1–4, (1986).

S. Penczek et al., Makromol. Chem., Macromol. Symp., 3, pp. 203–217 (1986).

M. Bednarek et al., Makromol. Chem. Suppl., 15, pp. 49–60 (1989).

C. C. Gonzales et al., Makromol. Chem., 190, pp. 1217–1224 (1989).

Naval Ordnance Laboratory NAVWEPS Report 7409, A Survey of Nitro–Organic Compounds Related to Solid Propellant Systems (U), pp. 34–37,61–64,121,129,130,132, 134, 137, 138,143–146, Jun. 20, 1961.

U.S. Naval Ordnance, NAVORD Report 2028, Polyglycidyl Nitrate, Part 1, Preparation and Characterization of Glycidyl Nitrate, NOTS 685, 13 pages plus abstract, May 6, 1953.

U.S. Naval Ordnance, NAVORD Report 2028, Polyglycidyl Nitrate, Part 2, Preparation and Characterization of Polyglycidyl Nitrate, NOTS 686, 20 pages plus abstract, May 7, 1953.

Jet Propulsion Laboratory, Publication No. 93, High–Performance Polyglycidyl Nitrate–Polyurethane Propellants, 33 pages, Mar. 29, 1957.

Defense Technical Information Center (DTIC), Document No. AD 144756, 1957.

Defense Technical Information Center (DTIC), Document No. AD 139462, 1957.

ACS Symp. Series 286, Ring–Opening Polymerization Kinetics, Mechanism and Synthesis, Chapter 25, Cationic Ring–Opening Polymerization of Epichlorohydrin in the Presence of Ethylene Glycol, Y. Ohamoto, pp. 361–372, J. E. McGrath, editor, ACS 1985.

ACS Symp. Series 286, Ring–Opening Polymerization Kinetics, Mechanism and Synthesis, Chapter 20, Homopolymerization of Epoxides in the Presence of Fluorinated Carbon Acids, J. Robins et al, pp. 263–274, J. E. McGrath, editor, ACS 1985.

Translation of article by Y. I. Estrin et al, Vysokomol. soyed., A10: No. 11, Kinetics of Polymerization of Epichlorohydrin Glycidyl Nitrate Catalyzed by $BF_3$, pp. 2589–2599, 1968.

Translation of article by A. I. Kuzayev et al, Vysokomol-.soyed., All: No. 5, Polymerization Kinetics of Tetrahydrofuran Caused by $BF_3$.THF in the Presence of Glycidyl Nitrate in 1,2–Dichloro–ethane, pp. 989–994, 1969.

Translation of article by S. G. Entelis et al, Vysokomol. soyed., A13: No. 6, Regularities of Cationic Polymerizaton of Cyclic Ethers, pp. 1438–1446, 1971.

G. V. Korovina et al., J. Poly. Science: Part C, No. 16 pp. 3575–3579 (1968).

*Primary Examiner*—Charles T. Jordan
*Assistant Examiner*—John R. Hardee
*Attorney, Agent, or Firm*—Madson & Metcalf; Ronald L. Lyons

[57] ABSTRACT

A family of high performance, clean, space motor/gas generator solid propellants based on polyglycidyl nitrate elastomer binder, ammonium nitrate oxidizer and small amounts of aluminum and/or boron and which do not require the presence of plasticizers. A high performance, space motor/gas generator solid propellant based on a polyglycidyl nitrate elastomer binder and ammonium nitrate oxidizer optimizes performance at low solids levels.

23 Claims, No Drawings

CLEAN SPACE MOTOR/GAS GENERATOR SOLID PROPELLANTS

FIELD OF THE INVENTION

This invention relates to clean, space motor/gas generator solid propellants based on a polyglycidyl nitrate elastomer binder and ammonium nitrate oxidizer and which optimize at low solids levels and produce essentially no particles in the exhaust.

BACKGROUND OF THE INVENTION

Solid high-energy compositions, such as propellants, explosives, gasifiers, or the like, comprise solid particulates, such as fuel particulates and/or oxidizer particulates, dispersed and immobilized throughout a binder matrix comprising an elastomeric polymer.

Binders previously used in composite solid propellant formulations have generally been non-energetic polymers such as polycaprolactones, polyethyleneglycols or polybutadienes. Since about 1950 there has been a considerable need to develop energetic binders with satisfactory mechanical properties in order to provide safer binders at higher energy levels and to increase the energy level or specific impulse in a propellant formulation. For the most part only nitrocellulose has found usefulness as an energetic polymer binder. However, nitrocellulose suffers from undesirable mechanical properties. Alternatively, it has been proposed to employ conventional non-energetic polymer binders in combination with energetic plasticizers such as for example, nitroglycerine, butanetriol trinitrate, and trimethylolethane trinitrate. It has also been suggested that the energetic polymer nitrocellulose be employed with either non-energetic or energetic plasticizers in an attempt to improve mechanical properties. However, none of these proposals has led to fully acceptable energetic binder formulations.

Furthermore, there are many occasions when the use of plasticizers is undesirable or their use is not possible, such as when "clean" space motor/gas generator propellants or "clean" large launch vehicle propellants are required. The propellants used in the current generation of space motor/gas generator solid propellants, such as those used in small retro rockets to separate stages on launch vehicles, such as for satellite launch vehicles, e.g. Titan Retro, all employ about 84 wt. % ammonium perchlorate (AP) as the oxidizer and small amounts of aluminum, i.e. about 2% wt. Thus these propellants produce large amounts of gaseous HCl, about 18–20 mol %, and particulate $Al_2O_3$ in their exhaust. The HCl and $Al_2O_3$ can coat and/or destroy the optics and other sensitive parts of the satellites. There is therefore a need for solid propellants that could be used in these applications which would produce little or essentially no contamination or particles in their exhaust upon combustion.

There has been a continuing need for energetic polymers to be available for use in formulating solid high-energy compositions, such as propellants, explosives, gasifiers and the like. In this regard much recent work has centered on attempts to produce acceptable energetic polymers of glycidyl azide polymer and poly(oxytanes). A problem with elastomeric binders formed from poly(oxytanes) is their tendency to have mechanical characteristics less than that which would be desirable for a high-energy composition, particularly for a rocket motor propellant. It is especially difficult to provide poly(oxytane) binders having adequate stress capabilities. On the other hand giycidyl azide polymer is synthesized by first polymerizing epichlorohydrin to poly(epichlorohydrin) which is then converted to glycidyl azide polymer by reaction with sodium azide in dimethylsulfoxide. Beside the lack of a simple synthesis process, the production of glycidyl azide polymer requires relatively expensive reagents. Moreover, even after the polymer is synthesized it has been found that unplasticized glycidyl azide polymer-ammonium perchlorate solid propellants require about 78% solids to optimize Isp at about 254 sec.

Since the early 1950's poly(glycidyl nitrate), hereinafter referred to as PGN, has been known and recognized as a possible energetic prepolymer. The initial work on PGN was done by Thelan et al. at the Naval Ordnance Test Station (NOTS, now the Naval Weapons Center, NWC). They studied the polymerization of glycidyl nitrate by a variety of Lewis Acid catalysts with most of the work centering on the use of stannic chloride as a catalyst. No propellants were prepared by the NOTS workers and they noted that one drawback to their synthesis was the laborious purification procedure.

PGN AND PGN propellants were next examined at the Jet Propulsion Laboratory (JPL) by Ingnam and Nichols and at Aerojet General Corporation by Shookhoff and Klotz. The JPL workers found that PGN made using boron trifluoride etherate was low in both functionality (i.e. <2) and molecular weight (MW=1500) and therefore polyurethane propellants made from this PGN had poor mechanical properties. Similar observations were made by the Aerojet workers. In summary, it has long been recognized that PGN may be an excellent energetic polymer but until now a method of synthesis could not be found that would produce nearly difunctional material with acceptable hydroxyl equivalent weights. Nor has it been possible to formulate acceptable unplasticized "clean" PGN space motor/gas generator solid propellants having reduced levels of solids.

It is therefore desirable to provide a family of high energy, clean, space motor/gas generator solid propellants and particularly such propellants which produce essentially no $Al_2O_3$, HCl or chloride ion or particles in their exhaust. A further object of this invention is to provide such a family of high energy, clean, space motor/gas generator solid propellants which employ ammonium nitrate as the oxidizer and do not require the use of ammonium perchlorate as the oxidizer nor aluminum as the fuel. A still further object of this invention is to provide such clean, space motor/gas generator solid propellants containing PGN elastomer binder, ammonium nitrate oxidizer and boron. An even further object of this invention is to provide such high energy, clean, space motor/gas generator solid propellants requiring reduced solids loading to obtain optimized performance as measured by the specific impulse of the propellants and yet producing essentially no $Al_2O_3$, HCl or chloride ions or particles in their exhaust. Yet another object of this invention is to provide such high energy, clean, solid propellants which perform as well as or better than the current space motor/gas generator solid propellants but which produce essentially no HCl or chloride ions in their exhaust.

SUMMARY OF THE INVENTION

It has been discovered that high energy, solid propellants which are clean, space motor/gas generator solid propellants, not requiring the presence of a plasticizer, can be provided by utilizing a curable polyglycidyl nitrate (PGN) binder and a reduced amount of energetic ammonium nitrate oxidizer and fuel solid particulate particles wherein the PGN employed is a PGN having a functionality of nearly 2.0 or more and a hydroxyl equivalent weight of about 1000–1700 or more. More preferably such high energy solid propellants which are clean space motor/gas generator solid propellants are provided by utilizing an isocyanate curable PGN binder having a functionality of nearly 2.0 or more, a hydroxyl equivalent weight of about 1200 to 1600 and wherein the PGN employed has less than about 2 to 5% by weight cyclic oligomer present in the PGN.

DETAILED DESCRIPTION OF THE INVENTION

In concurrently filed application Ser. No. 07/561,797, filed Aug. 2, 1990, there is described a process for the production of PGN that produces nearly difunctional material with acceptable hydroxyl equivalent weights, particularly PGN having a functionality of nearly 2.0 or more, or essentially equivalent to the hydroxy functionality of the polyol initiator employed in the process, and a hydroxyl equivalent weight of about 1000–1700 or more, preferably about 1200 to 1600. Moreover, that Application provides a process for producing PGN that has present greatly reduced amounts of cylic oligomer, that is about 2–5% by weight or less of said oligomer.

In said concurrently filed Application, the improved process for the production of PGN, in which cylic oligomer formation is suppressed and PGN having a functionality substantially equal to the functionality of the polyol initiator and an acceptable hydroxyl equivalent weight is obtained, is provided by a process wherein a catalyst-initiator complex is formed and reacted with glycidyl nitrate (GN) and wherein the ratio of mols catalyst/mol hydroxyls in the initiator is <1:1, the glycidyl nitrate is added to the catalyst-initiator complex reaction mixture at a rate substantially equivalent to the rate at which it reacts with the complex such that no effective net amount of glycidyl nitrate monomer is built up, i.e. monomer is used up essentially as fast as it is added to the reaction mixture, and the reaction temperature is maintained within the range of from about 10°–25° C. Additionally, the process provides for the removal of any potential alkoxide groups, such as ethoxide groups, from the catalyst-initiator complex mixture when the catalyst employed in the process leads to the formation of such groups.

According to the process described in said concurrently filed Application glycidyl nitrate,

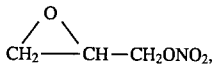

is polymerized to PGN,

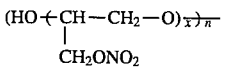

initiator, wherein n is an integer essentially equivalent to the hydroxy functionality of the initiator and x is an integer representing the repeating units, by forming a catalyst-initiator complex and reacting the complex with glycidyl nitrate and wherein the ratio of mols catalysts/mols hydroxyls in the initiator is <1:1, the glycidyl nitrate monomer is added to the catalyst-initiator complex reaction mixture at a rate in which the monomer is used up (reacted) essentially as fast as it is added, and the reaction temperature is maintained at a temperature within the range of from about 10° to 25° C.

The polymerization reaction is a cationic polymerization process conducted using a polyol initiator and an acid catalyst. The acid catalyst may be chosen from among those known in the art, including $BF_3$, $HBF_4$ and triethyloxonium hexafluorophosphate (TEOP). The Lewis acid catalyst forms a preinitiator complex with the polyol, for example, butanediol is known to form a complex with boron trifluoride ($BF_3$).

The polyol initiator employed generally has the hydroxyl groups of the polyol unhindered. The polyol is preferably a diol. As examples of suitable diols there may be mentioned ethylene glycol, propylene glycol, 1,3-propanediol and 1,4-butanediol. Suitable triols include, but are not limited to glycerol, trimethylolpropane and 1,2,4-butanetriol. A suitable tetrol is, but is not limited to 2,2'-dihydroxymethyl-1,3-propanediol. The molecular weight of the polyol is relatively low, preferably less than 500, more preferably below 300 and most preferably below about 150.

The acid catalyst is used at a much lower level relative to hydroxyl groups of the polyol than is taught in the prior art. It was discovered that a much more controlled reaction occurs if the catalyst, such as a Lewis Acid, is used at a molar ratio relative to hydroxyl groups of the polyol of less than 1:1, preferably from about 0.4:1 to about 0.8:1. If a proton acid is used as the catalyst, the ratio of hydrogen ions released by the acid catalyst to the hydroxyl groups of the alcohol is also less than 1:1, preferably 0.4:1 to about 0.8:1. By using a substantially lower level of acid catalyst, incorporation of a greater percentage of the polyol molecules internally within polymer molecules is achieved, cylic oligomer formation is suppressed to a level of about 2 to 5% or less, and lower polydispersity is achieved.

The cationic polymerization reaction may be carried out in a suitable organic solvent conducive to the cationic polymerization. If a solvent is employed, such suitable solvent is a non-protic, non-ether, inert solvent. Such solvents include, but are not limited to methylene chloride, chloroform, and 1,2-dichloroethane.

The polymerization reaction is conducted in a manner whereby the glycidyl nitrate monomer is added to the reaction mixture at a rate essentially equivalent to its rate of reaction, so that no effective net concentration of monomer is built up in the reaction mixture and the reaction temperature is maintained at a temperature within the range of from about 10° to 25° C., preferably from about 11° to 17° and most preferably about 13° to 15° C. It will be appreciated that the faster heat is taken away from the reactive mixture the faster glycidyl nitrate monomer can be added to the reaction mixture.

When the reaction of catalyst and initiator results in the formation of alkoxide groups in the catalyst-initiator complex, such as for example, the presence of alkoxide group compounds in the reaction mixture formed by the reaction of boron trifluoride etherate and 1,4-butanediol, the resulting PGN products are low in functionality. Pre-reacting the polyol 1,4-butanediol and boron trifluoride etherate and then removing diethylether under vacuum produces a PGN product essentially free of alkoxide groups. If, however, the catalyst and initiator would not form products containing such alkoxide groups, such as when boron trifluoride gas is employed instead of boron trifluoride etherate, then prereaction of the catalyst and initiator and removal of potential alkoxide compounds is not necessary.

The hydroxyl equivalent weight of the PGN polymer produced according to this process will generally be from about 1000 to 1700 or more, preferably from about 1200 to about 1600 and the amount of cyclic oligomer produced will generally be about 2–5% by weight or less.

It has been discovered that the improved PGN produced according to the process of said concurrently filed Application permits the production of high energy, clean, space motor/gas generator solid propellants not requiring the presence of a plasticizer. The high energy, solid propellants of this invention require greatly reduced amounts of solid particulate materials in order to obtain optimized performance as measured by the specific impulse of the propellant. The solids content may be as low as about 60% by weight, and is preferably about 75–85%, most preferably about 80–85%, by weight. The high energy, solid propellants of this invention produce greatly reduced amounts of condensates and HCl, preferably about 0% of each. Furthermore, the lower solids levels permits better processability of the solid propellant formulations.

It is surprising that the PGN propellants of this invention provide optimized performance at reduced solid levels. With the plasticizer-free, reduced solids content solid propellants of this invention it is possible to obtain clean, space motor/gas generator solid propellants with a specific impulse of about 230 to 240 or more pounds force-sec per pound mass at 1000–14.7 psi pressure. Theoretical calculations show that such propellants optimize in the 82–83% solids range and produce Isp's as high as 237 lb-sec/lb.

Although a plasticizer is not required it will be recognized that it is possible to add suitable plasticizers to the solid propellants of this invention for applications wherein the presence of a plasticizer is not prohibited or is not undesirable. In such cases any suitable plasticizer may be employed and generally in a small amount generally about 5% by weight or less of plasticizer, and most preferably less than about 2% by weight. As examples of suitable plasticizers which may be present in the high energy solid propellants there may be mentioned high-energy plasticizers such as nitroglycerine (NG), butanetriol trinitrate (BTTN), trimethylolethane trinitrate (TMETN) and triethylene glycol dinitrate (TEGDN).

The high energy, space motor/gas generator solid propellants will generally comprise from about 60 or more wt. %, preferably about 70–85 wt. % and most preferably about 80–85%, particulate solids, including fuel material particulates and oxidizer particulates. The fuel particulates employed in the space motor/gas generator solid propellant formulations of this invention can be aluminum or boron, generally in an amount of no more than about 2% by weight. Particulate oxidizer material employed is ammonium nitrate (AN) but can also include cyclotetramethylene tetranitramine (HMX), cyclotrimethylene trinitramine (RDX) and other high energy nitramines such as CL-20 and the like and mixtures thereof. The high energy solid propellants may optionally include minor amounts of additional components known in the art, such as bonding agents and burn rate modifiers such as diaminoglyoxime (DAG) or diaminofurazan (DAF) and the like.

Cured PGN elastomers are formed by curing PGN with isocyanates having a functionality of at least two or more, such as for example, hexamethylene diisocyanate (HMDI), toluene diisocyanate (TDI), and polyfunctional isocyanates, such as for example, Desmodur N-100 available from the Mobay Chemical Co., a division of Farbenfabriken Bayer AG, and mixtures thereof.

The following is a typical example of a method for the preparation of poly(glycidyl nitrate) according to the aforementioned concurrently filed application, suitable for use in the high energy space motor/gas generator solid propellants of this invention. A clean, dry, three neck r.b. flask is equipped with a vacuum adapter, rubber septum, magnetic stirring bar and a thermometer. The flask is charged with 29.7 g (0.33 mole) of dry 1,4-butanediol, cooled to 20° C. and 46.8 g (0.33 mole) of $BF_3$ etherate is slowly added via a syringe while maintaining the temperature below 25° C. This mixture is stirred for 1 hr. at 25° C. then the ether is removed by pulling a partial vacuum for 1 hr. and a full vacuum for 16 hrs. Dry methylene chloride (175 ml) is added to the flask and the contents are transferred using a cannula to a clean dry 5 liter jacketed resin flask previously filled with 400 ml dry methylene chloride and cooled to 10° C. equipped with a mechanical stirrer, thermometer, $N_2$ purge, and a peristaltic addition pump. An additional 25 ml of dry methylene chloride is used to insure quantitative transfer of the catalyst initiator complex. The temperature in the reactor is adjusted to 13°±2° C. and a solution of 1190 g (10 moles) of monomer grade glycidyl nitrate in 800 ml of dry methylene chloride is added at such a rate as to maintain a temperature of 13°±2° C. This typically takes 4.5 hours. The reaction is stirred for 0.5 hr. then quenched by the addition of 400 ml of a saturated sodium chloride solution. The brine solution is separated and the methylene chloride solution of PGN is washed three times with 500 ml of saturated sodium bicarbonate solution. The methylene chloride solution is dried over magnesium sulfate and the methylene chloride removed on a rotoevaporator at a pressure of <1 mm and a temperature of 40° C. (1 hr.) and 55° C. (2 hrs.) to give essentially a quantitative yield of poly(glycidyl nitrate) as a viscous light yellow liquid.

The invention is now illustrated in greater detail by way of the following illustrative examples. In all the following examples the PGN prepolymer employed in the binder of the solid propellants is one prepared according to the preceding illustrative preparation and having a molecular weight of about 2500 and a hydroxyl equivalent weight of about 1250. The binder contains about 0.47% at mononitroaniline (MNA) as a nitrate ester stabilizer and about 0.03% at triphenylbismuth (TPB) as a urethane cure catalyst. Theoretical specific impulse values are calculated according to the program described in Gordon, S. and McBride, B., "Computer Program for Calculation of Complex Chemical Equilibrium Composition, Rocket Performance, Incident and Reflected Shock and Chapman-Jouquet Detonations", NASA SP-273 (1976).

Table I sets forth the theoretical specific impulses, densities and density Isp's for various high-energy, unplasticized space motor PGN propellants of this invention at a 1000/14.7 psi pressure, and also for corresponding glycidyl azide polymer (GAP) solid propellants. The binder in the PGN propellants comprise the PGN prepolymer and N-100/HMDI (50:50) curative isocyanate. Each formulation contained AN oxidizer particles and 2% wt. boron particles.

TABLE I

Theoretical Performance of PGN and GAP Space Motor Propellants

| | % Binder | % AN | % B | Isp lb-sec/lb 1000-14.7 psi | Density lb/in$^3$ | Density Isp lb/sec/in$^3$ |
|---|---|---|---|---|---|---|
| PGN Propellants | 40 | 58 | 2 | 228.4 | 0.0573 | 13.10 |
| | 35 | 63 | 2 | 230.6 | 0.0580 | 13.37 |
| | 30 | 68 | 2 | 232.9 | 0.0586 | 13.65 |
| | 25 | 73 | 2 | 234.5 | 0.0592 | 13.88 |
| | 20 | 78 | 2 | 236.3 | 0.0599 | 14.15 |
| | 17 | 81 | 2 | 237.0 | 0.0602 | 14.27 |
| | 15 | 83 | 2 | 236.10 | 0.0606 | 14.30 |
| GAP Propellants | 40 | 58 | 2 | 216.6 | 0.0554 | 12.00 |
| | 35 | 63 | 2 | 221.0 | 0.0563 | 12.44 |
| | 30 | 68 | 2 | 225.7 | 0.0571 | 12.89 |
| | 25 | 73 | 2 | 229.7 | 0.0580 | 13.32 |
| | 20 | 78 | 2 | 233.6 | 0.0590 | 13.78 |
| | 15 | 83 | 2 | 236.3 | 0.0600 | 14.18 |

The data shows that the PGN propellants optimize in the 82.83% total solids range. Moreover, the clean PGN propellants produce a higher specific impulse at lower total solids levels and provide better density Isp's than corresponding GAP propellants.

Table II sets forth the density, flame temperature and theoretical Isp's for various other space motor PGN solid propellants of this invention. The binder in the PGN propellants comprise the aforedescribed PGN prepolymer and N-100/HMDI (50:50) curative isocyanate.

TABLE II

Theoretical Performance of PGN/AN Solid Propellants

| Percent by Weight | | | | | Density | Flame Temp | $Isp_{vac}$ | 1000 psi |
|---|---|---|---|---|---|---|---|---|
| Binder | AN | HMX | Al | B | lb/in$^3$ | °F. | E = 50 | E = 100 |
| 40 | 60 | — | — | — | .0579 | 3996 | 276.2 | 282.7 |
| 30 | 70 | — | — | — | .0590 | 4163 | 279.5 | 285.9 |
| 20 | 80 | — | — | — | .0601 | 3793 | 266.4 | 272.1 |
| 25 | 75 | — | — | — | .0595 | 4126 | 280.7 | 287.2 |
| 23 | 77 | — | — | — | .0597 | 4020 | 275.5 | 281.6 |
| 27 | 73 | — | — | — | .0593 | 4172 | 280.4 | 286.8 |
| 26 | 74 | — | — | — | .0594 | 4156 | 280.6 | 287.0 |
| 25 | 65 | 10 | — | — | .0600 | 4313 | 283.8 | 290.3 |
| 25 | 65 | 9 | 1 | — | .0602 | 4387 | 286.2 | 292.9 |
| 25 | 65 | 9 | — | 1 | .0601 | 4322 | 285.9 | 293.1 |
| 25 | 65 | 8 | — | 2 | .0602 | 4322 | 287.9 | 295.6 |
| 25 | 65 | 8 | 2 | — | .0603 | 4460 | 288.4 | 295.3 |
| 25 | 66 | 7 | 2 | — | .0603 | 4449 | 288.1 | 295.1 |
| 25 | 64 | 9 | 2 | — | .0604 | 4471 | 288.7 | 295.6 |
| 25 | 63 | 10 | 2 | — | .06045 | 4481 | 288.9 | 295.9 |
| 25 | 58 | 15 | 2 | — | .0607 | 4528 | 290.2 | 297.2 |
| 30 | 60 | 10 | — | — | .0595 | 4250 | 282.2 | 288.7 |
| 30 | 60 | 8 | 2 | — | .0598 | 4400 | 286.9 | 293.8 |
| 30 | 58 | 12 | 2 | — | .0601 | 4436 | 287.9 | 294.9 |
| 30 | 55 | 15 | 2 | — | .0602 | 4460 | 288.6 | 295.6 |
| 30 | 55 | 15 | — | 2 | .0601 | 4299 | 288.2 | 295.8 |

In Table III are set forth properties of four space motor PGN solid propellants of this invention.

E = expansion ratio

TABLE III

| | Propellant No. | | | |
|---|---|---|---|---|
| | 1 | 2 | 3 | 4 |
| Binder, % | 25 | 25 | 40 | 35 |
| NCO/OH | 0.9 | 0.8 | 1.0 | 1.0 |
| Curative ratio | N-100/HMDI (70:30) | N-100/HMDI (70:30) | N-100/HMDI (50:50) | N-100/HMD (50:50) |
| AN, %, 200μ | 51.1 | 52.1 | 40.6 | 44.1 |
| AN, %, 20μ | 21.9 | 22.9 | 17.4 | 18.9 |
| B, % | 2.0 | 0.0 | 2.0 | 2.0 |
| Stress, psi | 265/264 | 198/191 | 154/142 | 196/195 |
| Strain, % | 13/13 | 19/29 | 33/40 | 30/36 |
| Modulus, psi | 3100 | 2130 | 725 | 1000 |
| Burn rate at 4000 psi, in./sec | 0.74 | 0.54 | 0.61 | 0.63 |
| Exponent | 0.5 | 0.82 | 0.45 | 0.46 |
| EOM viscosity, kP (at 100° F.) | 60 | 168 | 6 | 14 |
| Density (theory), g/cc | 1.64 | 1.63 | 1.59 | 1.60 |
| Isp, lb-sec/lb | 235.4 | 232.7 | 228.4 | 230.6 |

A 450 gram batch of solid propellant No. 4 of Table III was prepared in the following manner. Into a suitable mixing vessel, under vacuum, the PGN, MNA and boron ingredients were added and mixed for about 15 minutes. To the mixture 50% by weight of each of the course and fine AN were added and mixed for a further 15 minutes after which the remaining 50% of each of the course and fine AN were added and mixed for an additional 15 minute period. Then TPB in toluene was added and mixed for a further period of about 15 minutes followed by addition thereto of the N-100/HMDI mix which was subjected to a further mixing for a period of about 15 minutes. The propellant was allowed to cure for 3 days at 135° F.

With the foregoing description of the invention, those skilled in the art will appreciate that modifications may be made to the invention without departing from the spirit thereof. Therefore, it is not intended that the scope of the invention be limited to the specific embodiments illustrated and described.

We claim:

1. A high energy, space motor solid propellant having a theoretical specific impulse, at a chamber pressure of 1000 psi expanding to 14.7 psi, of at least about 230 lb-sec/lb, said propellant comprising an isocyanate cured polyglycidyl nitrate binder and from about 60 to about 85% by weight high energy particulate solids comprising ammonium nitrate oxidizer particulates and wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

2. A high energy solid propellant of claim 1 wherein the particulate solids comprise from about 80 to 85% by weight.

3. A high energy, space motor, plasticizer-free, solid propellant comprising an isocyanate cured polyglycidyl nitrate binder and from about 60 to about 85% by weight high energy particulate solids comprising ammonium nitrate oxidizer particulates, wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate and said solid propellant upon combustion producing less than about 1.25% weight condensables and less than about 7 mol % by weight HCl.

4. A high energy, space motor, plasticizer-free, solid propellant of claim 3 wherein the particulate solids comprise from about 80 to 85% by weight.

5. A high energy, space motor, plasticizer-free, solid propellant of claim 3 wherein the particulate solids also comprise up to about 2% by weight of boron.

6. A high energy, space motor, plasticizer-free, solid propellant of claim 3 wherein the particulate solids also comprise up to about 2% by weight aluminum.

7. A high energy, space motor, plasticizer-free, solid propellant of claim 4 wherein the particulate solid also comprise up to about 2% by weight aluminum.

8. A high energy, space motor, plasticizer-free, solid propellant of claim 3 wherein the particulate solids also comprise cyclotetramethylene tetranitramine.

9. A high energy, space motor, plasticizer-free, solid propellant of claim 5 wherein the particulate solids also comprise cyclotetramethylene tetranitramine.

10. A high energy, space motor, plasticizer-free, solid propellant of claim 6 wherein the particulate solids also comprise cyclotetramethylene tetranitramine.

11. A high energy, space motor, plasticizer-free, solid propellant of claim 3 wherein the propellant includes additional components selected from bonding agent, burn rate modifier, nitrate ester stabilizer and urethane cure catalyst.

12. A high energy, solid propellant of claim 2 wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

13. A high energy, solid propellant of claim 3 wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

14. A high energy, solid propellant of claim 4 wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

15. A high energy, solid propellant of claim 5 wherein the polyglycidyl nitrate is an isocyanate curable polyglycidyl nitrate polymer having a functionality of nearly 2.0 or more and a hydroxyl equivalent weight of from about 1000 to about 1700 land has less than about 2 to 5% by weight cyclic oligomer present in the polyglycidyl nitrate.

16. A high energy, solid propellant of claim 6 wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

17. A high energy, solid propellant of claim 7 wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

18. A high energy, solid propellant of claim 8 wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

19. A high energy, solid propellant of claim 9 wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

20. A high energy, space motor solid propellant having a theoretical specific impulse, at a chamber pressure of 1000 psi and expanding to 14.7 psi, of at least about 230 lb-sec/lb, said propellant comprising about 15 to about 40% by weight of an isocyanate cured polyglycidyl nitrate binder and from about 60 to about 85% by weight of particulate solids and wherein the particulate solids comprise ammonium nitrate oxidizer particulates and optionally up to about 2% by weight metal fuel particulates selected from boron and aluminum and wherein the polyglycidyl nitrate is an isocyanate curable polyglycidyl nitrate polymer having a functionality of nearly 2.0 or more and a hydroxyl equivalent weight of from about 1000 to about 1700 and has less than about 2 to 5% by weight cyclic oligomer present in the polyglycidyl nitrate.

21. A high energy, space motor solid propellant of claim 20 wherein the particulate solids comprise about 80 to 85% by weight.

22. A high energy, space motor solid propellant of claim 20 which is plasticizer free and upon combustion produces less than about 1.25% by weight condensables and less than about 7 mol % by weight HCl.

23. A high energy, space motor solid propellant of claim 21 which is plasticizer free and upon combustion produces less than about 1.25% by weight condensables and less than about 7 mol % by weight HCl.

* * * * *